US005668783A

United States Patent [19]

Bugmann

[11] Patent Number: 5,668,783

[45] Date of Patent: Sep. 16, 1997

[54] SOUND GENERATOR IN PARTICULAR FOR A TIMEPIECE

[75] Inventor: Rudolf Bugmann, Erlach, Switzerland

[73] Assignee: Eta SA Fabriques d'Ebauches, Grenchen, Switzerland

[21] Appl. No.: 710,250

[22] Filed: Sep. 13, 1996

[30] Foreign Application Priority Data

Sep. 21, 1995 [CH] Switzerland ..... 02 669/95

[51] Int. Cl.[6] ..... G04C 21/00; G04C 21/16; G10H 1/02

[52] U.S. Cl. ..... 368/250; 368/255; 84/702

[58] Field of Search ..... 368/72–74, 75, 368/244, 245, 246, 250, 255, 272–274; 84/671–673, 701–703, 737, 738

[56] References Cited

U.S. PATENT DOCUMENTS 4,236,437 12/1980 Howell et al. ..... 84/1.26
4,529,322 7/1985 Ueda ..... 368/255
4,567,806 2/1986 Kodaira ..... 84/1.26
4,796,503 1/1989 Lin ..... 84/1.26
5,493,543 2/1996 Kamens ..... 368/255

*Primary Examiner*—Vit W. Miska
*Attorney, Agent, or Firm*—Griffin, Butler, Whisenhunt & Kurtossy

[57] ABSTRACT

A sound generator comprises a transducer (3) intended to be supplied with a signal having a frequency determining the sound to be produced and having a variable amplitude (envelope). To this effect, the transducer is connected in series with the principal path of a semiconductor component (5). The control electrode of this semiconductor component (5) is connected to a RC-circuit (1, 7) capable of providing control pulse trains having said envelope.

The RC-circuit comprises a capacitor (7) and at least one input branch (13) of a current mirror (11) the output branch (12) of which supplies a control electrode of the semiconductor component (5). Preferably, the capacitor (7) is connected in series with the input branch (13).

Application in particular to wrist-watches equipped with an audible alarm.

9 Claims, 2 Drawing Sheets

SOUND GENERATOR IN PARTICULAR FOR A TIMEPIECE

Figure 1:
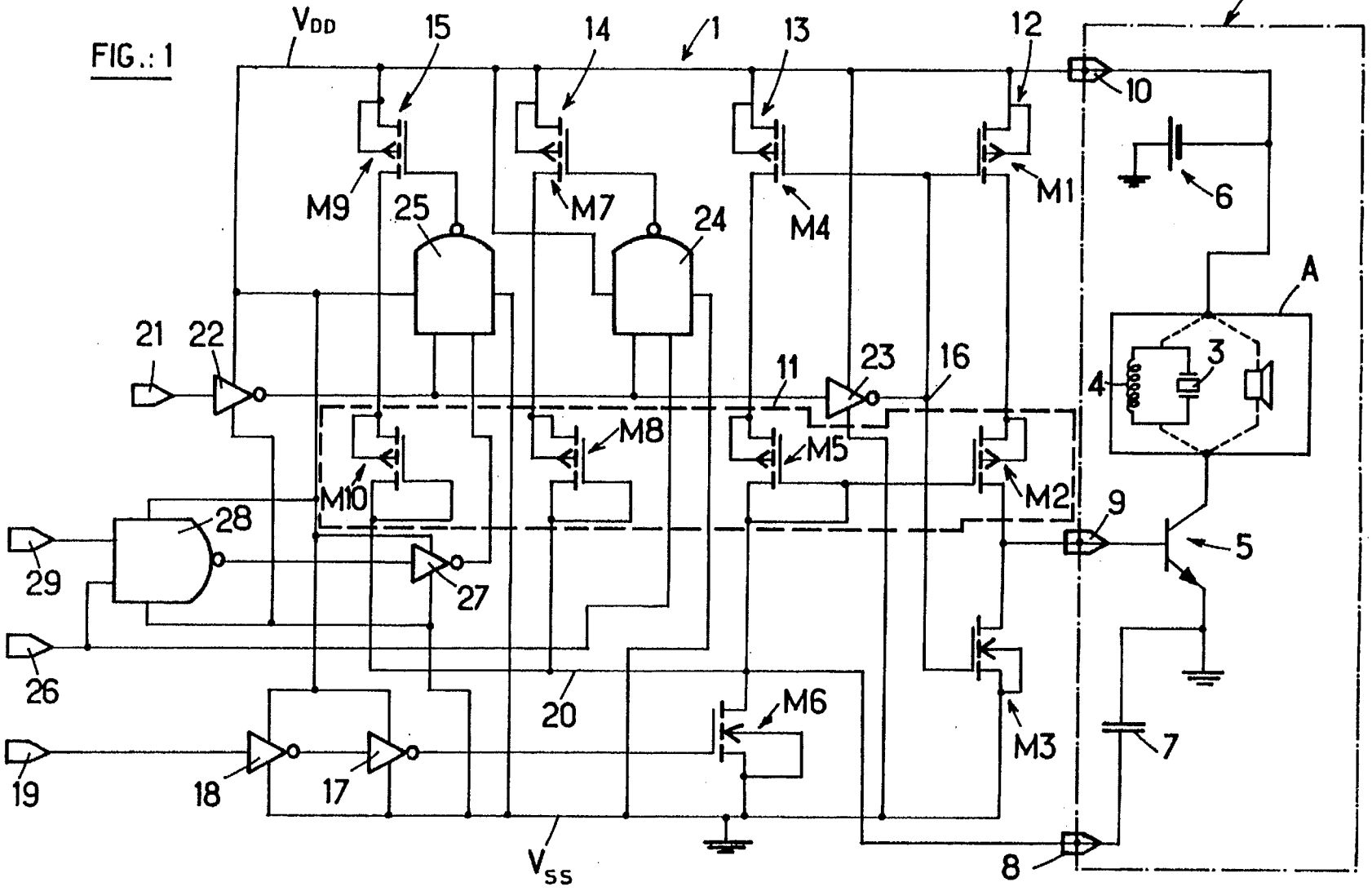

The present invention relates to a sound generator comprising an acoustic system which preferably has a piezoelectric or an electromagnetical element as transducer to produce sounds. In particular, the invention concerns a sound generator intended to generate a short melody which may for example be used as an alarm in a timepiece.

A sound generator of this type is known from the U.S. Pat. No. 4,567,806. In this prior art proposition, the acoustic system, here a sound transducer, is connected in series with a controlled current source such as a semiconductor component whose control electrode receives a melodious signal which is composed of pulses having a frequency of the musical note to be produced and having an amplitude which decreases progressively during a predetermined evanescence time. This decrease is provided so as to improve the sound quality of the note produced and to allow for a quality of the sound which approaches the quality to which the human hear is used to while listening to certain musical instruments.

The evanescence of the note produced is obtained by providing in the control circuit of the semiconductor component a capacity which is charged each time a note is to be produced and which is discharged during the production time of the note, i.e. in rhythm with the frequency of this note and by pulses of decreasing amplitude. This form of control signal is naturally reflected back into the principal circuit of the semiconductor component and, consequently, into the sound transducer.

This known circuit gives satisfaction as far as the sound quality of the generated melodies is concerned and is of relative simple realisation. It may thus be used with relative ease in timepieces and in particular in watches.

This prior art realisation presents, however, an inconvenience which is particularly related to its use in a wrist-watch, for which a minimal spare occupation of the pieces constituting the watch is primordial. Well then, although most of the components of the sound generator may be part of an integrated circuit of the watch thus ensuring the functioning of the timekeeping and other functions which are related to this, this is not true for the sound generator, for the semiconducting element, nor for the capacitance which is usually obtained by using a capacitor which has a value which can be as large as 6.8 μF. As these components cannot be integrated, they all need to find their place individually in the movement of the watch and the capacitor mentioned will, in view of its large value, occupy a lot of space.

An aim of the invention is to propose a sound generator of the type described briefly hereabove, but without having the mentioned inconveniences.

Another aim of the present invention is to propose such a generator which is of low cost and easy to manufacture.

The invention thus has as its object a sound generator, in particular for use as an alarm in a timepiece, intended to generate sounds of variable amplitude, and comprising a sound generator, in particular for use as an alarm of a timepiece, intended to generate sounds of variable amplitude and comprising an acoustic system connected in series with a controlled current source, a control electrode of said controlled current source being connected to a control circuit comprising a capacitor and which is capable of providing a control signal having a frequency which determines the note to be produced and having an envelope corresponding to said variable amplitude, said generator being characterized in that said control circuit further comprises a current mirror the output branch of which supplies said control electrode and an input branch of which is connected in series with said capacitor.

Figure 2:
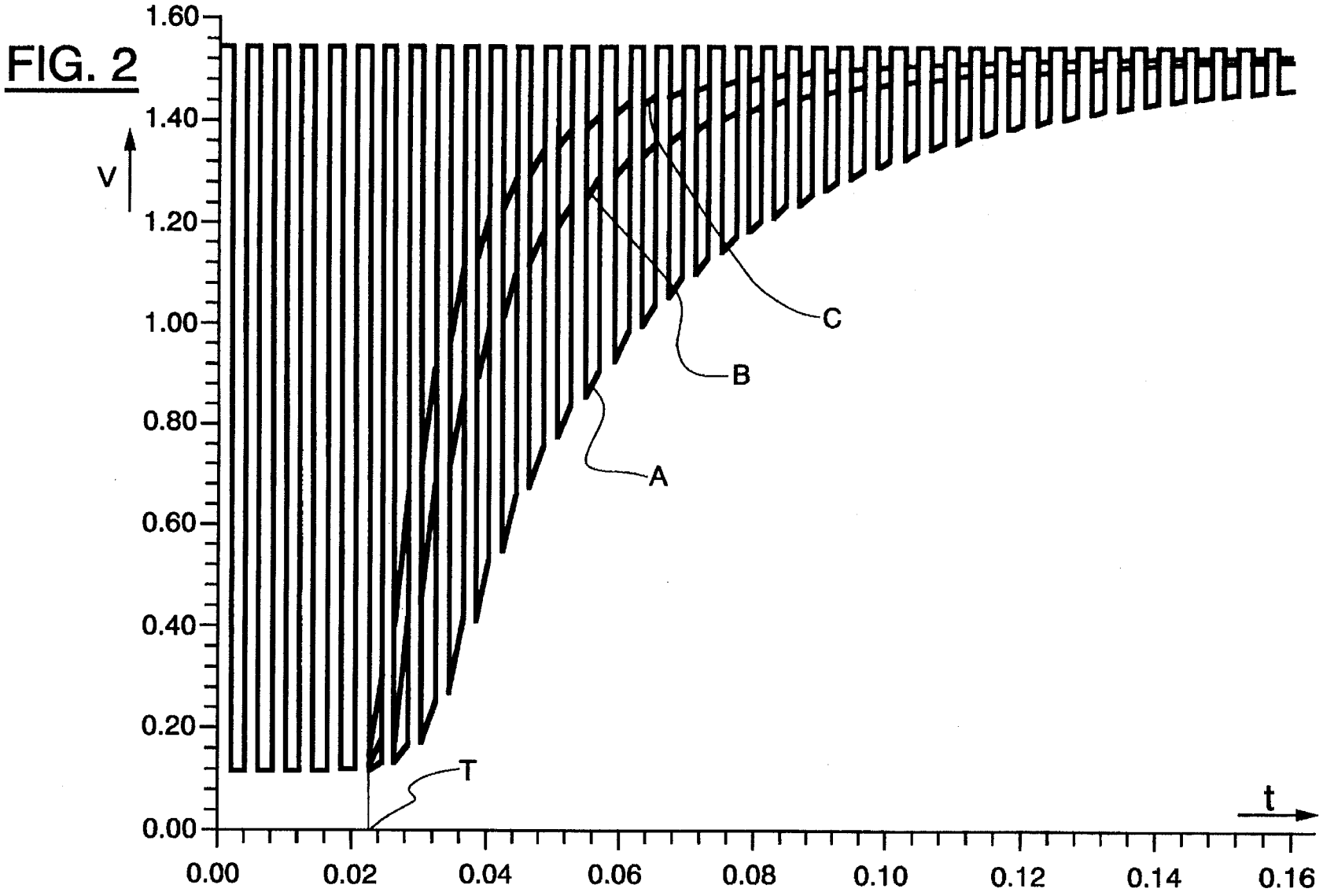

Other features and advantages of the invention will appear during the description which follows and which is given solely by way of an example and in which reference is made to the annexed figures in which:

FIG. 1 is a block diagram of a sound generator according to the invention, and FIG. 2 is a graph showing the voltage V as a function of the time t to illustrate the evolution of the sound signal produced by the generator according to the invention, so as to obtain a musical note, in which the acoustic system of the sound generator is replaced by a charge resistance.

Reference will now be made to FIG. 1 which represents the preferred mode for carrying out the invention.

In this example, the sound generator is intended more particularly to be incorporated as an alarm generator in a wrist-watch whereby the alarm is to reproduce a series of notes forming a melody.

In the represented embodiment, the sound generator comprises a first part 1 which is advantageously integrated with the circuit of the watch in the same chip of semiconducting material. A second part 2 is formed of discrete components for each of which space must thus be found in the movement of the timepiece. Clearly, this required space must be limited as much as possible.

This second part 2 of the sound generator comprises an acoustic system A comprising a transducer 3, which is preferably piezoelectric, connected in parallel with a coil 4 which is intended to produce, in a manner known as such, an over-voltage on transducer 3, for each applied pulse. This parallel assembly of transducer 3 and of coil 4 is connected in series with the collector-emitter path of a controlled current source, for example a bipolar transistor 5 of the NPN type, and which is provided by way of a discrete component. The emitter of this bipolar transistor 5 is connected to the ground while a battery 6 is connected between the aforementioned parallel assembly and the ground. It is to be noted that the sound transducer 3 may also be of the electromagnetical type.

A capacitor 7, which is called here the envelope capacitor, is connected between terminal 8 of part 1 of the sound generator and the ground. This part 1 comprises two other terminals byway of which this part is connected to part 2. One of these terminals, referenced 9, is connected to the base of transistor 5, while the other terminal, referenced 10, is connected to the positive terminal of battery 6. This latter provides the power supply voltage $V_{DD}$ for all the functional unities of part 1 of the integrated circuit. The other power supply voltage $V_{SS}$ is connected to the ground. All of the power supply connections of these functional units appear clearly in the diagram of FIG. 1 and they will thus not be explained in more detail hereafter.

According to an essential feature of the invention, the sound generator comprises a programmable current mirror which is realised with the help of MOS transistors and which is designated generally by the reference 11. This current mirror comprises an output branch 12 which contains the paths source-drain, respectively drain-source of three transistors, i.e. a P-type transistor M2 (the output of the mirror), another P-type transistor M1 and an N-type transistor M3 (the interrupters). Terminal 9 is connected to the node between the transistors M2 and M3 and thus controls the control electrode, which is in this example the base, of bipolar transistor 5. Output 12 of current mirror 11 thus provides the base-emitter current of this transistor.

Current mirror 11 also comprises three input branches 13, 14 and 15 which will be respectively referred to by "long", "average" and by "short" in the following description for reasons which will become clear hereinafter.

The first 13 of these input branches, the "long" branch, also comprises a series connection of the paths source-drain, respectively drain source of three transistors, i.e. a P-type transistor M5 (the input of the mirror), a transistor M4, which is also P-type and a N-type transistor M6 (the interrupters).

The grids of transistors M1, M3 and M4 are connected to each other and form a node 16. The grids of transistors M2 and M5 are connected to each other and also to the drain of transistor M5. The grid of transistors M6 is connected to an assembly of two inverters 17 and 18 which are connected in series and the input of which is connected to a terminal 19 which is called the "long driver" terminal and which leads to the exterior of this part of the integrated circuit. The drain of transistor M6 is connected to a node 20, which is the input of the current mirror, and to which is further connected terminal 8, or in other words the envelope capacitor 7.

The "average drive" branch 14 comprises a series connection of the paths source-drain of two P-type transistors M7 and M8. The source of transistor M7 has the voltage $V_{DD}$, while the drain of the transistor M8 is connected to node 20. The grid of transistor M8 is also connected to this node 20.

A similar assembly is provided for the "short drive" branch 15 and it comprises transistors M9 and M10. Transistors M2, M5, M8 and M10 thus form a programmable current mirror. The programming is done with the help of transistors M7 and M9. The grids of transistors M1, M3 and M4 are connected to a control terminal 21, which is called the melody terminal, by the intermediate of two inverters 22 and 23 which are connected in series.

The grids of transistors M7 and M9 are respectively connected to the outputs of two NAND-gates 24 and 25. The first input of each of these gates are connected to the output of inverter 22. The other input of the NAND-gate 24 is connected to an "average drive" control terminal 26. The other input of the NAND-gate 25 is connected to the output of an inverter 27 the input of which is connected to the output of a NAND-gate 28. A first input of the latter is connected to terminal 26, while the other input of this gate is connected to a "short drive" terminal 29.

The functioning of this sound generator is the following.

The melody signal is applied to terminal 21. It may be generated for example by a pulse counter (not represented) which provides successive pulse trains of a predetermined duration and of an appropriate frequency so as to reproduce the notes of the desired melody. The corresponding signal is applied by way of the inverters 22 and 23 to the grids of transistors M1, M3 and M4 and by way of the NAND-gates 24, 25 to the grids of transistors M7 and M9. The input and the output of the current mirror 11 are thus activated and desactived according to the rhythm of these pulse trains.

Also, transistor M6 is connected to the input 20 of the current mirror 11 and is connected in parallel to the envelope capacitor 7. The voltage of terminal 19 may change from voltage $V_{DD}$ to voltage $V_{SS}$ and inversely. As long as this voltage rests at the voltage $V_{DD}$, transistor M6 will be conducting, so that the input 20 of the current mirror is forced to have the voltage $V_{SS}$, and the capacitor 7 is short-circuited; the envelope function is thus inhibited. Terminals 26 and 29 will be forced to the voltage $V_{SS}$, so that the voltage $V_{SS}$ will be applied to terminal 19 which will have as an effect to render transistor M6 non-conducting so that capacitor 7, until now discharged, will start charging due to a series of current pulses flowing through the first input branch 13 of current mirror 11. These current pulses have an amplitude which varies from one pulse to another as a function of the loading diagram of capacitor 7. Hence, this branch 13 is comparable to a RC-circuit, in combination with capacitor 7.

However, the ratio of currents which may flow in the respective branches 12 and 13 of mirror 11 is determined by the construction and is a function of the dimensional ratio of the transistors constituting the mirror. In other words, the envelope of the current pulse train which is formed in the output branch 12 will follow that of the pulse train which charges capacitor 7. This has as a consequence that the pulse train flowing through the base of bipolar transistor 5 presents an envelope which has the same form as that of the current in branch 13. This is in its turn reflected back in the principal circuit of transistor 5 so that transducer 3 will also receive an equivalent pulse train.

This finally results in an evanescence of the note produced by transducer 3 as a function of the loading diagram of capacitor 7.

It should further however be noted that with each pulse, the intensity of the charging current of capacitor 7 will have a value which is proportionally lower compared to the intensity of the base current of transistor 5 as a function of the ratio of mirror 11. As such, it is possible to obtain a given loading diagram by choosing a capacitor which has a capacity, compared to that of the capacitor used in prior art technique, which will be reduced by this same ratio of the mirror.

More specifically, if in the prior art assembly of the cited American patent, a capacitor is required of 6.8 μF and if, on the other hand, a ratio of the current mirror 11 is equal to for example 14, a capacitor 7 will suffice now which has a value of about 480 nF. It will thus be understood that thanks to the features of the invention, the capacitor is much smaller, so that much less space will be needed for accomodating it. Furthermore, its manufacturing price will be much lower.

Branches 14 and 15 allow to modify the ratio of the current mirror 11 as a function of the control signals applied to terminals 26 and 29. For example, if an "average drive" is chosen by forcing terminal 26 to voltage $V_{DD}$, branch 14 will be connected in parallel to branch 13. Due to this, the ratio of the mirror and thus also of the currents will be reduced as a function of the dimensional relationship which is chosen for the transistors of the three branches 12, 13 and 14 thus activated. The ratio may be chosen of for example 7.

This effect may be further increased if terminal 29 is also forced to voltage $V_{DD}$, so that the three branches 13, 14 and 15 are put in parallel and form the input of current mirror 11. A current ratio may thus be obtained which is even further reduced and which is for example about 4.7.

FIG. 2 shows, byway of example only, the shapes of the waves obtained by replacing transducer 3 and coil 4 by a resistance which is equivalent to that of the coil. The curves A, B and C represent respectively the cases of a "long drive", an "average drive", and a "short drive" starting at an instant t=T at which the drive signals are applied to the respective terminals 19, 26 and 29. The melody signal is applied to terminal 21 starting at a time t=0. These curves were obtained using the values of the current ratio and of the capacitance of capacitor 7 such as indicated hereabove.

Although only one embodiment of the generator according to the invention has been described hereabove, the invention is not limited to this specific embodiment, which is given solely by way of a non-limitative example of the invention.

What is claimed is:

1. A sound generator, in particular for use an alarm in a timepiece, intended to generate sounds of variable amplitude and comprising an acoustic system connected in series with a controlled current source, a control electrode of said controlled current source being connected to a control circuit comprising a capacitor and which is capable of providing a control signal having a frequency which determines the note to be produced and having an envelope corresponding to said variable amplitude, wherein said control circuit further comprises a current mirror the output branch of which supplies said control electrode and an input branch of which is connected in series with said capacitor.

2. A sound generator according to claim 1, wherein said controlled current source is a bipolar transistor.

3. A sound generator according to claim 1, wherein said capacitor is connected in parallel to switching means intended to inhibit the envelope of said control signal.

4. A sound generator according to claim 1, wherein said control circuit comprises switching means connected to a control terminal for generating at the output of said current mirror a control signal having said frequency of said note to be produced.

5. A sound generator according to claim 1, wherein said current mirror comprises at least a second input branch and control means for allowing a selective parallel connection of said second input branch with its first input branch.

6. A sound generator according to claim 1, wherein said current mirror is realized by way of an integrated circuit comprising MOS transistors.

7. A sound generator according to claim 1, wherein said acoustic system comprises a transducer connected in parallel with a coil.

8. A sound generator according to claim 1, wherein said transducer is of the piezoelectric type.

9. A sound generator according to claim 1, wherein said control circuit comprises switching means arranged so as to avoid a charging of said capacitor during the inactive phases of said current mirror.

* * * * *